United States Patent [19]

Svoboda

[11] Patent Number: 4,592,264

[45] Date of Patent: Jun. 3, 1986

[54] VIOLIN FAMILY INSTRUMENTS WITH INTEGRATING TONAL ARM

[76] Inventor: Daniel Svoboda, 4001 West 30th Ave., Denver, Colo. 80212

[21] Appl. No.: 614,553

[22] Filed: May 29, 1984

[51] Int. Cl.[4] ..... G10D 1/02

[52] U.S. Cl. ..... 84/274; 84/275; 84/294

[58] Field of Search ..... 84/274–283, 84/291, 294

[56] References Cited

U.S. PATENT DOCUMENTS 360,317 3/1887 Loppentien ..... 84/275

2,414,238 1/1947 Osburn ..... 84/275

3,678,794 7/1972 Tansky ..... 84/275

3,699,837 10/1972 Annessa ..... 84/291

*Primary Examiner*—Lawrence R. Franklin

*Attorney, Agent, or Firm*—Sheridan, Ross & McIntosh

[57] ABSTRACT

There is disclosed a bass fiddle of the violin family of instruments having a sound box made from blown fiberglass reinforced resins and wood top plate. An integrating tonal arm is located in the upper chamber of the sound box and eliminates overtones in the upper chamber and produces uniform tonal retention of all strings in all positions.

10 Claims, 2 Drawing Figures

VIOLIN FAMILY INSTRUMENTS WITH INTEGRATING TONAL ARM

FIELD OF THE INVENTION

This invention relates in general to stringed instruments and more particularly with the violin family, primarily the violin, viola, cello, and double bass violin.

BACKGROUND OF THE INVENTION

In the violin family, a musical tone that is produced is intensified and amplified by supplementary vibration induced in the resonating cavity of the sound box and in the top plate of the instrument.

Conventionally in the violin family, all sizes are constructed similarly with a neck and scroll, fingerboard, top plate, back plate and side case, bridge, strings, tailpiece, bass bar, sound post, and "F" hole. As the strings are excited by picking or bowing, the sound waves are transmitted through the bridge to the top plate, which in turn sets up an adiabatic action of the air in the sound box chamber, producing musical sounds which are eventually emitted through the "F" holes. The sound post acts as a dampening device as well as a structural post for the string pressure exerted on the bridge. This arrangement may produce overtones in the upper chamber of the sound box which overtones have differential tonal retentions and may reduce both the tonal quality and volume of the sound. Therefore, it is desirable to provide means for use in the violin family to produce musical instruments of the violin family with improved tonal quality and balanced tonal retention.

BRIEF SUMMARY OF INVENTION

In accordance with this invention, violin family instruments are provided which have a blown fiberglass reinforced resin backplate and side case which form the sound chamber and a conventional white wood top sound plate. An integrating tonal arm assembly is provided and functions to eliminate the overtones produced in the upper chamber. Also, the integrating tonal arm assembly provides additional structural integrity to the neck heel, to resist neck deflection caused by the tension of the instrument strings. The vibration dampening of the upper sound chamber effected by the integrating tonal arm produces a clear, well-balanced and velvety tonal quality.

It is an object of this invention to provide members of the violin family with means to assure a uniform tonal retention.

It is another object of this invention to provide members of the violin family with increased tonal volume by the elimination of tonal overtones in the upper sound chamber.

It is a further object of this invention to reduce the physical size of the members of the violin family without sacrificing any of their musical qualities.

Other features and advantages of the invention will be apparent from the following more particular description of preferred embodiments as illustrated in the accompanying drawings in which like reference characters refer to the same parts throughout the various views. The drawings are not necessarily to scale, emphasis instead being placed upon illustrating the principles of the invention.

DETAILED DESCRIPTION OF THE INVENTION

Figure 1:
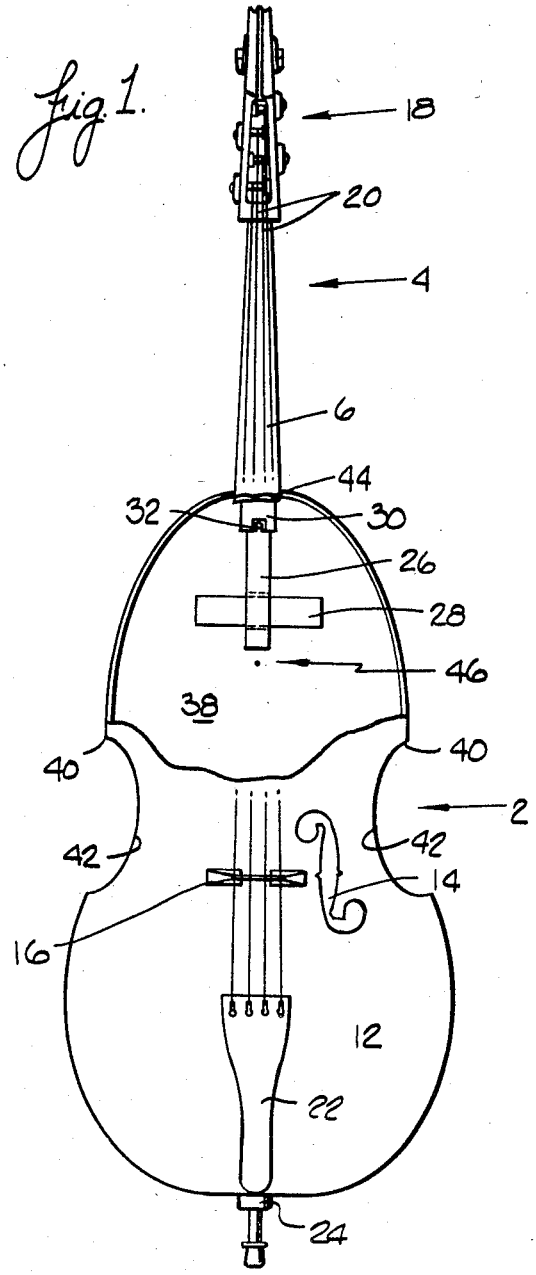
FIG. 1 is a plan view of a violin with parts broken away to illustrate the present invention.
Figure 2:
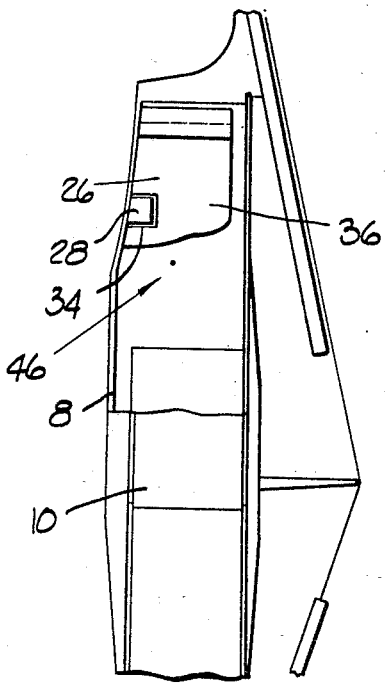
FIG. 2 is a side elevation of the inventive concepts of FIG. 1.

In FIGS. 1 and 2, there is illustrated a bass fiddle 2 embodying the present invention. The bass fiddle 2 has a neck 4 and fingerboard 6. The sound box of the bass fiddle 2 comprises a back plate 8, sidecase 10 and top plate 12 in which the F hole 14 is provided. A bridge 16 bears on to the surface of the top plate 12.

At the upper end of the neck 4, there is provided the peg box 18 from which the strings 20 extend downwardly over the bridge 16. The strings 20 are secured to the tail piece 22 which is anchored to the end pin assembly 24. A conventional sound post (not shown) and a conventional bass bar (not shown) are also provided.

The preferred embodiment of the invention is illustrated in FIGS. 1 and 2 and comprises an integrating tonal arm assembly comprising a neck heel extension 26 and a cross member 28. As illustrated in the drawing, the neck heel extension 26 is secured to the neck heel 30 by a dove tailed joint 32 with a suitable cement being used to form a strong tight joint. The neck heel extension 26 and the cross member 28 are secured to the inner surface of the back plate 8 by a suitable cement that has high structural strength that is compatible with the materials being joined and possesses great fatigue qualities to sustain the vibrations associated with the playing of the violin. The neck heel extension 26 is provided with an opening 34 for receiving the cross member 28. As illustrated in FIG. 2, the preferred embodiment of the opening 34 and the cross member 28 are rectangular in cross section. The upper surface 36 of the neck heel extension 26 is adjacent to but spaced from the top plate 12.

The neck heel extension 26 and the cross member 28 are located in the upper chamber 38 of the bass fiddle 2. The upper chamber is generally defined in the violin family as that portion of the sound box extending between a line between the points 40 of the cut outs 42 and the juncture 44 of the neck 4 and the sound box. As illustrated in the drawing, the cross member 28 extends in a longitudinal direction and has a longitudinal axis. In the preferred embodiment of the invention, the midpoint of the longitudinal axis of the cross member 28 is located between the centroid 46 of the bass fiddle 2 and the juncture 44. The centroid 46 of the bass fiddle is the center of gravity of the upper chamber. In the preferred embodiment of the invention, the distance between the centroid 46 and the longitudinal axis of the cross member 28 is between about 17 and 25 percent of the distance between the centroid 46 and the juncture 44 and most preferably is located at a distance of 20 percent of the distance between the centroid 46 and the juncture 44. The cross member 28 has a length which in the preferred embodiment is equal to about 45 to 55 percent of the distance between the side case 10 of the bass fiddle 2 at that location and most preferably has a length which is about 50 percent of the distance between the side case 10 of the bass fiddle 2 at that location. The cross member 28 is perpendicular to the neck heel extension 26 and extends equidistantly in each direction from the center line of the neck heel extension 26. In the preferred embodiment, the neck heel extension extends between the neck heel 30 and the centroid 46 and terminates adjacent to but spaced from the centroid 46.

In one embodiment of the invention, the bass fiddle 2 is of standard dimensions. The neck heel extension 26 has a width of about $1\frac{7}{8}$ inches; a height of about 4 inches and a length of about 14 inches. The cross member 28 has a width of about $2\frac{1}{2}$ inches, a height of about $1\frac{7}{8}$ inches and a length of about 11 inches. The back plate 8 and the side case 10 are integrally molded using an epoxy resin reinforced with glass fibers. The neck heel extension 26 and the cross member 28 are lightweight spruce and are secured to the back plate 8 with an epoxy cement. Epoxy cement is used to secure the neck heel extension 26 to the cross member 28.

While the preferred embodiments of the invention have been illustrated and described herein, it may be otherwise embodied and practiced within the scope of the following claims.

What is claimed is:

1. In a stringed musical instrument of the violin type comprising a sound box having an upper chamber and a centroid associated therewith, a side case, a top plate and a neck with a conventional neck heel inserted into said sound box, an improvement comprising:

an extension of the conventional neck heel connected to the conventional neck heel and extending along the longitudinal extent of the instrument, said neck heel extension having a length less than the longitudinal extent of the instrument; and a cross member connected to said neck heel extension with said neck heel extension having a length sufficient to intersect said cross member, said cross member having a longitudinal axis spaced from the centroid and wherein the distance between said longitudinal axis and the centroid is about 17–25% of the distance between the centroid and the end of the upper chamber adjacent to the neck, said neck heel extension and said cross member provided together to reduce overtones in the upper chamber.

2. In a musical instrument as in claim 1 wherein:

said cross member is located intermediate of the ends of said neck heel extension.

3. In a musical instrument as in claim 1 wherein:

said cross member is rectangular in cross-section.

4. In a musical instrument as in claim 3 wherein:

said neck heel extension has a rectangular opening adjacent to said back plate; and a portion of said cross member located in said rectangular opening.

5. In a musical instrument as in claim 4 wherein:

the distance between said longitudinal axis and said centroid is about 20 percent of the distance between said centroid and the end of said upper chamber adjacent to the neck; and said cross member has a length of about 50 percent of the distance between said side case at said location.

6. In a musical instrument as in claim 5 wherein:

said neck heel extension terminates at a location between said centroid and the end of said upper chamber adjacent to the neck.

7. In a musical instrument as in claim 6 wherein:

said neck heel extension is rectangular in cross section; and said neck heel extension has an upper surface adjacent to but spaced from the top plate.

8. In a musical instrument as in claim 7 wherein:

said side case comprises a molded reinforced plastic; and said neck heel extension and said cross member comprise wood.

9. In a musical instrument as in claim 1 wherein:

said neck heel extension is a linear extension of the conventional neck and neck heel; and said cross member extends in a direction perpendicular to said neck heel extension.

10. In a musical instrument as in claim 1 wherein:

said cross member has a length of at least 45 percent of the distance between the side case at said location.

* * * * *